US006055744A

United States Patent [19]

Schulz et al.

[11] Patent Number: 6,055,744

[45] Date of Patent: May 2, 2000

[54] METHOD FOR DETECTING IMPERMISSIBLE OPERATING STATES IN ELECTRONICALLY CONTROLLED TUMBLE DRYERS

[75] Inventors: Manfred Schulz; Uwe-Jens Krausch, both of Berlin, Germany

[73] Assignee: BSH Bosch und Siemens Hausgeraete GmbH, Munich, Germany

[21] Appl. No.: 09/156,438

[22] Filed: Sep. 18, 1998

[30] Foreign Application Priority Data

Sep. 18, 1997 [DE] Germany ..... 197 41 160

[51] Int. Cl.[7] ..... F26B 3/34

[52] U.S. Cl. ..... 34/491

[58] Field of Search ..... 34/260, 261, 273, 34/274, 419, 486, 491, 495, 496, 560, 552, 553, 557, 558

[56] References Cited

U.S. PATENT DOCUMENTS 5,755,041 5/1998 Horwitz ..... 34/491

*Primary Examiner*—Henry Bennett
*Assistant Examiner*—Alein Cadalso
*Attorney, Agent, or Firm*—Herbert L. Lerner; Laurence A. Greenberg; Werner H. Stemer

[57] ABSTRACT

A method for detecting impermissible operating states in electronically controlled tumble dryers, in particular the state of motion of a laundry drum. In the method, the electrical conductivity of the laundry is determined by electrodes which touch the laundry, at least from time to time. The method is distinguished by the fact that, during the drying operation, the conductivity is periodically measured. The currently measured conductivity value is compared with at least one previously measured conductivity value and, if changes in conductivity that are determined from the compared values over a multi-period interval corresponds to a preset low range of fluctuation, an indication is given that the laundry drum is stationary.

4 Claims, 1 Drawing Sheet

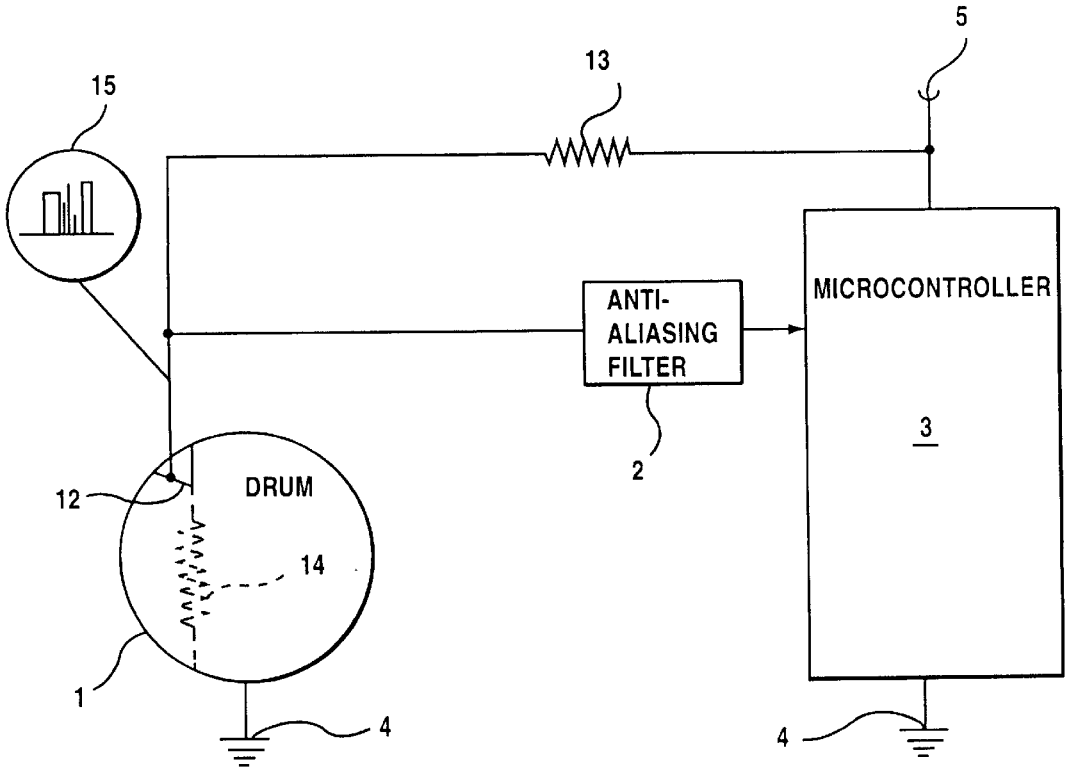
5
13
15
MICROCONTROLLER
ANTI-
ALIASING
FILTER
3
2
DRUM
12
14
1
4
4

METHOD FOR DETECTING IMPERMISSIBLE OPERATING STATES IN ELECTRONICALLY CONTROLLED TUMBLE DRYERS

BACKGROUND OF THE INVENTION

FIELD OF THE INVENTION

The present invention relates to a method for detecting impermissible operating states in electronically controlled tumble dryers, in particular the state of motion of the laundry drum. During a drying operation, laundry is moved in a laundry drum having electrodes. The electrical conductivity of the laundry is periodically measured as a result of contact occurring at least from time to time between the laundry and the electrodes of the laundry drum.

In tumble dryers, laundry is put into a drum, the drum is set into motion and heated air is moved through the drum, whereby moisture is removed from the laundry and the laundry is thus dried.

During the drying operation, it is possible for critical states to occur if, for example, the drive for the laundry drum has a fault, which is the case, for example, in the event that the drive belt of the laundry drum breaks. As a result of which the normal drying operation cannot be completed.

The occurrence of the fault is not detected by a temperature measurement of the tumble dryer, since the normal quantity of process air continues to flow around all the temperature regulators, in which the temperature regulators are set to and registering normal operating temperatures.

In order to detect the fault of a stalled drum and, if appropriate, to abort the drying operation, various solutions have been proposed.

In one of the solutions known from the prior art, the torn belt is detected via end-position switches, but this disadvantageously requires an additional outlay for components and corresponding control devices.

In another proposed solution, the rotary motion of the drum is registered by optoelectronic components, which once again necessitates an additional outlay for components, and the corresponding electronic control devices.

SUMMARY OF THE INVENTION

It is accordingly an object of the invention to provide a method for detecting impermissible operating states in an electronically controlled tumble dryers which overcomes the hereinafore-mentioned disadvantages of the heretofore-known methods of this general type, in which additional components, such as sensing elements and switches, are unnecessary, and that it is possible for the impermissible operating state to be determined in the simplest way with the use of existing components.

With the foregoing and other objects in view there is provided, in accordance with the invention, a method for detecting a still stand condition of an electronically controlled tumble dryer, which includes: moving a load of laundry in a laundry drum having electrodes during a drying operation; periodically measuring electrical conductivity of the laundry as a result of contact occurring from time to time between the laundry and the electrodes of the laundry drum; deriving a plurality of compared values by repeatedly comparing a currently measured conductivity value with at least one previously measured conductivity value; and determining that the laundry drum is stationary if changes in the measured electrical conductivity determined from the plurality of compared values over a multi-period interval corresponds to a preset low range of fluctuation.

According to the invention, the method of detecting impermissible operating states is distinguished by the fact that, during the drying operation, the conductivity of the laundry is periodically measured. The currently measured conductivity value is compared with at least one previously measured conductivity value and, if the change in conductivity that is determined from the compared values over the multi-period interval corresponds to a preset low range of fluctuation, an indication is given that the laundry drum is stationary.

Advantageously, therefore, using the conductivity measurement that is already taken in the tumble dryer, it is possible in the simplest way to determine the fact that the laundry drum is stationary.

Advantageously, if it is indicated that the laundry drum is stationary, the drying operation is aborted, so that even in the event of a drying operation that is not watched by the user, partial overheating of the laundry, which can result when the drum is stationary, is avoided.

In an advantageous refinement of the method of the invention, the low range of fluctuation is preset as a function of the load in the laundry drum. This has the advantage that an impermissible switching off of the drying operation during the rotation of the drum is avoided. In the event of a very high load, in particular at the start of the drying operation, and due to the fact that the high moisture of the laundry can cause the moist laundry to rest continually on the electrodes, the change in the conductivity is very low and an inadvertent switching off must be avoided. The range of fluctuation of the conductivity is therefor preset to be correspondingly low.

In a preferred embodiment, the range of fluctuation may also be equal to zero or essentially equal to zero.

Other features which are considered as characteristic for the invention are set forth in the appended claims.

Although the invention is illustrated and described herein as embodied in a method for detecting impermissible operating states in an electronically controlled tumble dryers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single FIGURE of the drawing is a block circuit diagram of circuit configuration for implementing one embodiment of the method of the invention.

DESCRIPTION OF THE PREFERRED EMBODIMENTS

Referring now to the single FIGURE of the drawing in detail, there is shown a laundry drum 1 with a measuring electrode 12. In addition, the drum 1 itself serves as a second electrode. In order to obtain the conductivity of laundry in the drum 1, the drum 1 is connected to a ground 4 of the tumble dryer, and the electrode 12 is connected via a bias resistor 13 to a constant voltage source 5. The laundry in the drum 1 has a laundry resistance 14, which is connected on one side, via the drum 1, to the ground 4 of the tumble dryer and, on the other side, the laundry is connected sporadically, via the electrode 12, to the resistor 13, and thus forms with the latter a voltage divider. At the junction between the laundry resistance 14 and the resistor 13, a conductivity signal 15 is measured which serves as a measure of the conductivity of the laundry. The conductivity signal 15 may advantageously be connected to the input of an anti-aliasing filter 2, whose output is connected to an analog input of a microcontroller 3.

When the laundry in the drum 1 is moving as a result of the rotation of the drum 1, the laundry comes into contact, at least from time to time, with the electrode 12, which results in the conductivity signal 15 changing over time. Each time the electrode 12 is contacted by a piece of laundry, or each time the laundry resistance 14 measured between the electrode 12 and the drum 1 changes, the conductivity signal 15 will exhibit a jump or a pulse. In the cases in which no piece of laundry touches the electrode 12, or a piece of laundry touches the electrode only slightly, and therefore a low conductivity is determined, the measured conductivity signal 15 exhibits a minimum value. Given a good electrical connection between the electrode 12 and the laundry, on the other hand, the conductivity signal 15 will exhibit a maximum value.

If the drum 1 is stationary because of a faulty drive, the conductivity no longer changes or changes only insignificantly, since either one and the same piece of laundry always rests on the electrode 12 or, if the electrode is located in the upper region of the drum, no piece of laundry rests on it permanently, and thus the conductivity is equal to zero.

A check is therefore made in the microcontroller 3 as to whether the conductivity value is fluctuating, and whether the fluctuation is greater than a preset low range of fluctuation or else a constant value (zero). If the value of the conductivity ascertained, or the ascertained change in the conductivity, lies in the preset low range of fluctuation, then an indication is given that the laundry drum is stationary. At the same time, or appropriately after this, the drying operation is aborted.

The method of the invention thus enables the fact that the laundry drum is stationary to be ascertained simply in a manner which is straightforward in terms of components and based on the conductivity measurement already present in the tumble dryer, which significantly reduces the production costs of the tumble dryer by comparison with the previous solutions from the prior art.

We claim:

1. A method of detecting a still stand condition of an electronically controlled tumble dryer, which comprises:

moving a load of laundry in a laundry drum having electrodes during a drying operation;

periodically measuring electrical conductivity of the laundry as a result of contact occurring from time to time between the laundry and the electrodes of the laundry drum;

deriving a plurality of compared values by repeatedly comparing a currently measured conductivity value with at least one previously measured conductivity value; and determining that the laundry drum is stationary if changes in the measured electrical conductivity determined from the plurality of compared values over a multi-period interval corresponds to a preset low range of fluctuation.

2. The method according to claim 1, which comprises aborting the drying operation if it is determined in the determining step that the laundry drum is stationary.

3. The method according to claim 1, which comprises presetting the low range of fluctuation in dependence on the load in the laundry drum.

4. The method according to claim 1, which comprises setting the preset low range of fluctuation to zero or substantially equal to zero.

* * * * *